US006167866B1

(12) United States Patent
Jakisch et al.

(10) Patent No.: US 6,167,866 B1
(45) Date of Patent: Jan. 2, 2001

(54) CONTROL DEVICE FOR CONTROLLING THE POWER OF A DRIVING ENGINE

(75) Inventors: Thomas Jakisch, Ostfildern; Uwe Hammer, Markgroeningen, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/359,042

(22) Filed: Jul. 23, 1999

(30) Foreign Application Priority Data

Sep. 7, 1998 (DE) ..... 198 40 677

(51) Int. Cl.[7] ..... F02D 9/08
(52) U.S. Cl. ..... 123/396; 123/399
(58) Field of Search ..... 123/399, 396, 123/361, 400, 403

(56) References Cited

U.S. PATENT DOCUMENTS 4,823,749 4/1989 Eisenmann et al. ..... 123/361
4,947,815 8/1990 Peter ..... 123/399
5,078,110 1/1992 Roderfeld ..... 123/399
5,285,757 2/1994 Entenmann et al. ..... 123/399
5,975,051 * 11/1999 Yamada et al. ..... 123/396
5,983,858 * 11/1999 Hashimoto et al. ..... 123/396

FOREIGN PATENT DOCUMENTS 0 285 868 A1 10/1988 (EP) .

* cited by examiner

*Primary Examiner*—Henry C. Yuen
*Assistant Examiner*—Hieu T. Vo
(74) *Attorney, Agent, or Firm*—Ronald E. Greigg; Edwin E. Greigg

(57) ABSTRACT

In actuating drives for throttle valves, it can happen that the throttle valve becomes stuck, for instance by freezing solid. In the control device proposed, even a throttle valve that has frozen relatively solidly in place can be shaken loose with a relatively weak actuating drive. The control device is suitable in particular for vehicles provided with a throttle type of internal combustion engine.

21 Claims, 4 Drawing Sheets

CONTROL DEVICE FOR CONTROLLING THE POWER OF A DRIVING ENGINE

BACKGROUND OF THE INVENTION

The invention is directed to improvements in control devices for controlling a power of a driving engine.

Modern engine controllers control the position of the throttle valve, typically disposed in the intake system of a driving engine for varying the power, in an electrical way. To that end, a control device operating with an electric motor is provided, or in other words an electrically actuatable throttle valve position, for instance of the kind described in German Offenlegungsschrift DE-OS 36 31 283, and in U.S. Pat. No. 4,947,815. The throttle valve position shown in these references has springs, which keep the throttle valve, in the currentless state, in a predetermined position that is different from the fully closed position. The actuating drive of the throttle valve position, when the throttle valve is closed beyond this emergency air position, must bring a torque to bear in the closing position, while on opening of the throttle valve to greater opening values, it must exert a torque in the opening direction for overcoming the spring forces. In such throttle valve positions, icing of the throttle valve support can occur in special operating states. Experience tells that this happens particularly on a short trip when the intake air temperatures are low. The water escaping from the engine oil via the crank case vent, for instance, is deposited in the form of ice in the region of the throttle valve. When the driving engine is turned off in cold surroundings, the engine heat at first warms up the throttle valve position; the ice melts and then collects in the lower region of the throttle valve. There, it forms a layer of ice again. The next time the engine is started, the throttle valve is firmly frozen in its position of repose, which in the case of the above throttle valve position means its emergency air position. The torque of the actuating drive that engages the throttle valve is not sufficient in all cases to push the ice out of the way and move the throttle valve. The result is restricted availability of the overall system.

From German Offenlegungsschrift DE 37 43 309 A and from U.S. Pat. No. 5,078,110, it is known in this connection to detect icing of a throttle valve from an increase in the difference between a set-point and actual values of a control variable for the throttle valve. If such icing is detected, then the control unit that controls the throttle valve turns the actuating drive on and off, or the actuating drive is triggered in such a way that it generates a reversing torque. In this way, the throttle valve is intended to be torn away and the icing is meant to be eliminated. It has also already been proposed that the throttle valve be made capable of moving using a shaking mechanism similar to a percussion drill. In a percussion drill, the shaking takes place in the direction of the pivot axis. However, it has been found that this proposal is not feasible in a control device for controlling the power of a driving engine, because the control element that determines the power of the engine must be built in with very narrow play. Particularly when the control element is a throttle valve, however, even the least jarring motion along the throttle valve shaft is impossible, because of the installation conditions required.

In German Patent Disclosure DE-A 41 35 913 and U.S. Pat. No. 5,285,757 it is proposed that in principle the throttle valve be triggered before starting, in such a way that it passes through its entire range of motion, in this way eliminating dirt and other things that can cause the throttle valve to seize. Yet even in this proposal, the actuating drive is incapable of adjusting the control element if the motion resistance at the control element is greater than the torque brought to bear by the actuating drive.

In European Patent Disclosure EP 0285 868 A1 published by the European Patent Office and in U.S. Pat. No. 4,823,749, it is proposed that if the throttle valve is solidly frozen, the field vector of the actuating drive be made to rotate at a frequency near the resonant frequency of the mechanical system. The resultant jarring motion is intended to break the throttle valve free. However, if it is solidly frozen, the throttle valve cannot move at all, and thus no jarring motion can be expected even if the field vector does rotate.

OBJECTS OF THE INVENTION

It is a principal object of the invention to overcome the above-described disadvantage and to increase the availability of the control device.

It is a further object of the invention that even a relatively firmly stuck control element can be torn loose, because when the control element is stationary the drive element can lift away from it and then, after a reversal of the direction and motion, can strike the control element with dynamic force. Advantageously, even a relatively weak actuating drive can therefore be used without impairing the functional safety and reliability. The proposed invention is especially helpful whenever no torque step-up gear is provided between the actuating drive and the control element.

It is yet another object of the invention that by means of the second drive stop on the drive element and the second control element stop on the control element, the advantage is obtained that the dynamic force of the drive element can act on the control element in both directions of motion. The advantageous result is that the control element is especially effectively jarred loose.

It is still another object of the invention that because of the two stops each on the drive element and the control element, the drive element is never adjusted beyond a certain amount in the direction of reducing the engine power without the control element necessarily going along with this motion.

It is yet an additional object of the invention to provide a detent device acting between the control element and the drive element having the advantage of assuring that the control element goes along with the motion of the drive element. This advantageously assures that even if flow forces, for instance, engage the control element, which for instance is a throttle valve, the control element cannot unintentionally lift away from the drive element. Typically, a restoring spring acting between a housing and the control element is provided. However, in the direction of lesser power of the engine, this restoring spring has a weaker action than in the range of high power of the engine. If the detent device were not present, then the restoring spring would have to be made strong enough that even in the range of low power of the engine, the force of the restoring spring would suffice for securely positioning the control element. The detent device at least partly takes on the task of making the control element reliably follow the motion of the drive element, so that the restoring spring can be designed with weaker force and thus advantageously can be smaller in size. This has the further advantage that the actuating drive only needs to counteract a restoring spring that is not as strong, so that the actuating drive can be still weaker and thus even more economical.

SUMMARY OF THE INVENTION

The detent device can advantageously be created very simply and without major effort with the aid of the magnetic force of one or more magnets that actuate the control element toward the drive element.

The actuating drive typically has one magnet. If the magnetic force of this magnet is employed such that at least some of the magnetic force assures an actuation of the control element toward the drive element, then the detent device can be furnished without any significant additional expense.

The coupling spring between the drive element and the control element advantageously, without major effort, assures reliable coupling of the motion of the control element with the motion of the drive element.

With the emergency spring, which keeps the control element in an emergency position by way of the drive element, the advantage is obtained that even if the actuating drive fails, continued operation of the engine with an emergency program is made possible.

The proposed system advantageously also makes it possible, in a version in which the control element that determines the power of the driving engine is supposed to remain in an emergency position if the engine is turned off or the actuating drive is defective, to knock the control element loose effectively, if a motion resistance engaging the control element, for instance from solid freezing, should exceed a certain amount.

The invention will be better understood and further objects and advantages thereof will become more apparent from the ensuing detailed description of preferred embodiments taken in conjunction with the drawings.

DESCRIPTION OF THE PREFERRED EMBODIMENTS

The control device of the invention can be used in any driving engine in which the engine power is to be controlled. The driving engine may either be mounted in stationary fashion, or it can be for a self-propelled machine, that is, a vehicle. The driving engine is by way of example an Otto engine with an intake conduit. In that case, the control element takes the form of a throttle valve, for instance. The driving engine may also be a Diesel engine; in that case, the control element can be an adjusting lever for adjusting the injection quantity of the injection pump. The driving engine may also be an electric motor. Then the control element is for instance a lever, with which the electric current to the electric motor can be varied.

Although not limited solely to this, in the ensuing description of the exemplary embodiments it will be assumed for the sake of simplicity that the control device of the invention is installed in a vehicle with an Otto engine.

Figure 1:
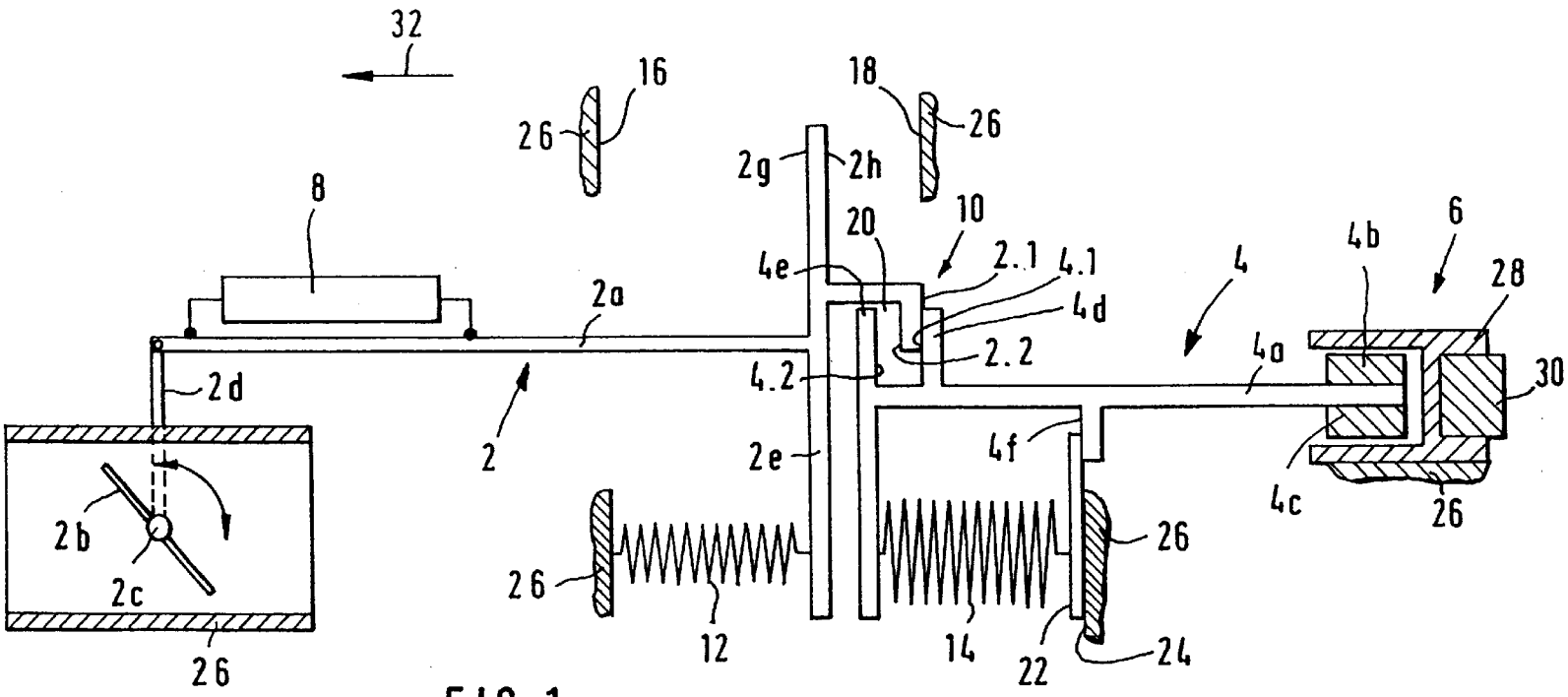
FIG. 1 is a linearized view of a first exemplary embodiment.

FIG. 1 symbolically shows a first especially selected and advantageous exemplary embodiment. For the sake of greater clarity in the drawing, the exemplary embodiment is shown linearized in FIG. 1.

FIG. 1 shows a control element 2, a drive element 4, an actuating drive 6, a travel sensor 8, a detent device 10, a restoring spring 12, an emergency spring 14, a maximum stop 16 structurally connected to the housing, a minimum stop 18 structurally connected to the housing, a free-wheel 20, a slaving element 22, portions of a housing 26, and an emergency operation stop 24.

The control element 2 for instance substantially comprises a driver 2*a,* a throttle valve 2*b,* a throttle valve shaft 2*c,* a connection 2*d,* and a spring articulation element 2*e.* A stop 2*g,* a stop 2*h,* a control element stop 2.1, and a second control element stop 2.2 are provided on the driver 2*a* of the control element. The driver 2*a,* the throttle valve 2*b,* the throttle valve shaft 2*c,* the connection 2*d,* and the spring articulation element 2*e* are coupled to one another in such a way that these parts can execute motion only jointly with one another.

The drive element 4 for instance substantially comprises a rotor 4*a,* a permanent magnet 4*b,* a permanent magnet 4*c,* a first slaving pin 4*d,* and a second slaving pin 4*e.* Depending upon the type of actuating drive 6, the rotor 4*a* is often also called the armature. A drive stop 4.1 is provided on the first slaving pin 4*d.* A second drive stop 4.2 is provided on the second slaving pin 4*e.* There is a slaving element stop 4*f* on the drive element 4. The rotor 4*a,* the permanent magnets 4*b,* 4*c,* the slaving pins 4*d,* 4*e,* the drive stop 4.1, the second drive stop 4.2, and the slaving element stop 4*f* of the drive element 4 are solidly coupled to one another with respect to motion.

The drive element 4, but in particular the rotor 4*a* and the permanent magnets 4*b,* 4*c,* as well as an iron core assembly 28 and a round magnet coil 30 are components of the actuating drive 6. The drive element 4 with the rotor 4*a,* the magnets 4*b,* 4*c,* the iron core assembly 28 and the magnet coil 30 form a small electric drive mechanism, in which depending upon the current supply to the magnet coil 30 the drive element 4 can be placed exactly in whatever position is desired at the time. With the aid of the travel sensor 8, it can be checked whether the control element 2 is following the motion of the drive element 4.

An arrow 32 is shown. The arrow 32 points in the direction of higher power of the driving engine, or in other words in the full-load direction. An adjustment of the control element 2 in the direction of the arrow 32 means an increase in power of the driving engine; correspondingly, an adjustment of the control element 2 counter to the arrow 32 means a reduction of the power of the driving engine.

In the linearized view in FIG. 1, the driver 2*a* and the rotor 4*a* move rectilinearly. In many cases, especially whenever the engine power is controlled by a pivotably supportive throttle valve, the control element 2 is designed overall such that it executes a pivoting motion concentric with the throttle valve shaft 2*c.* The drive element 4 of the actuating drive 6 is also typically supported in such a way that it executes a rotary motion concentric with the throttle valve shaft 2*c,* or at least axially parallel with the throttle valve shaft 2*c.*

Figure 2:
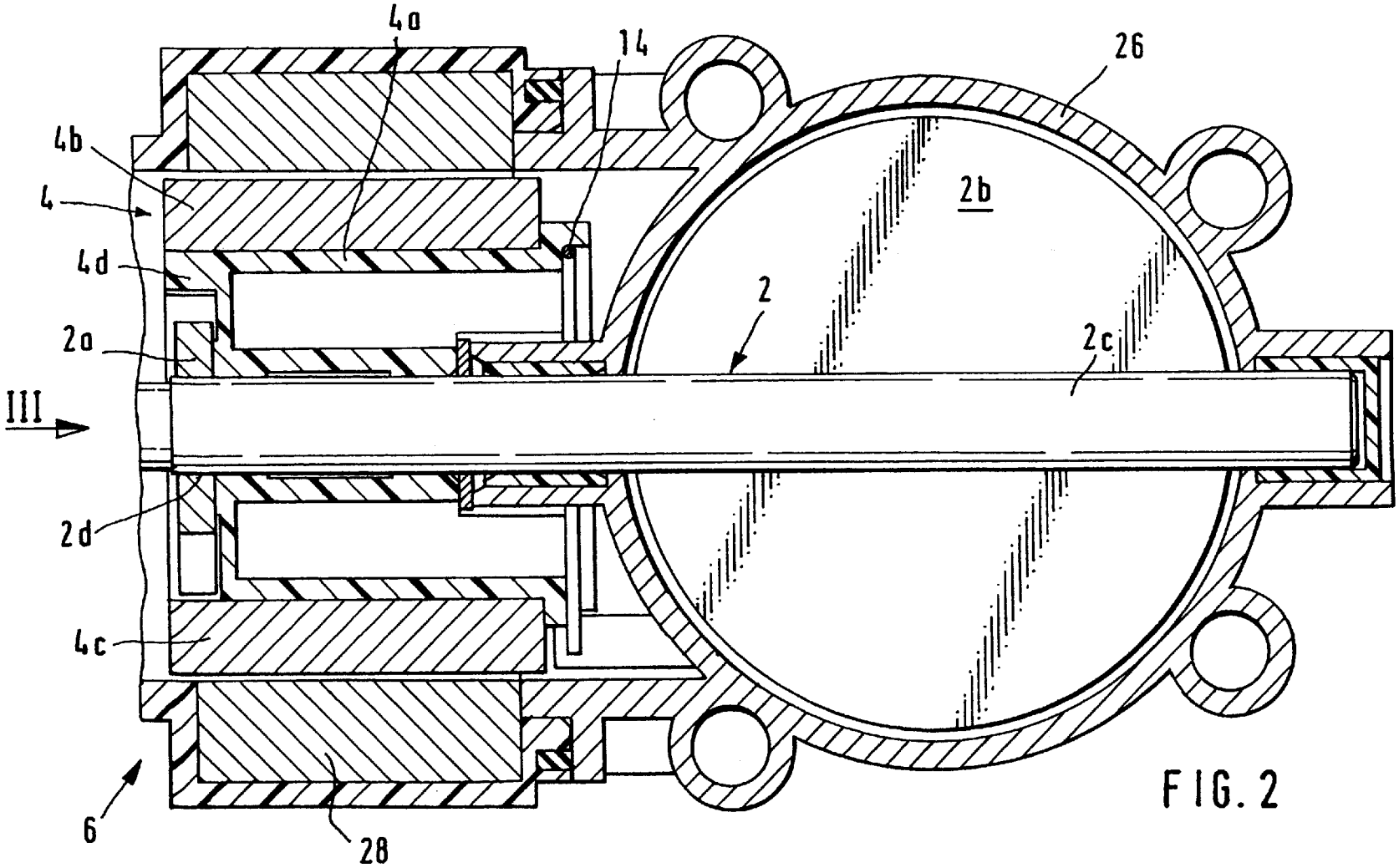
FIG. 2 is a longitudinal section of the first exemplary embodiment.
Figure 3:
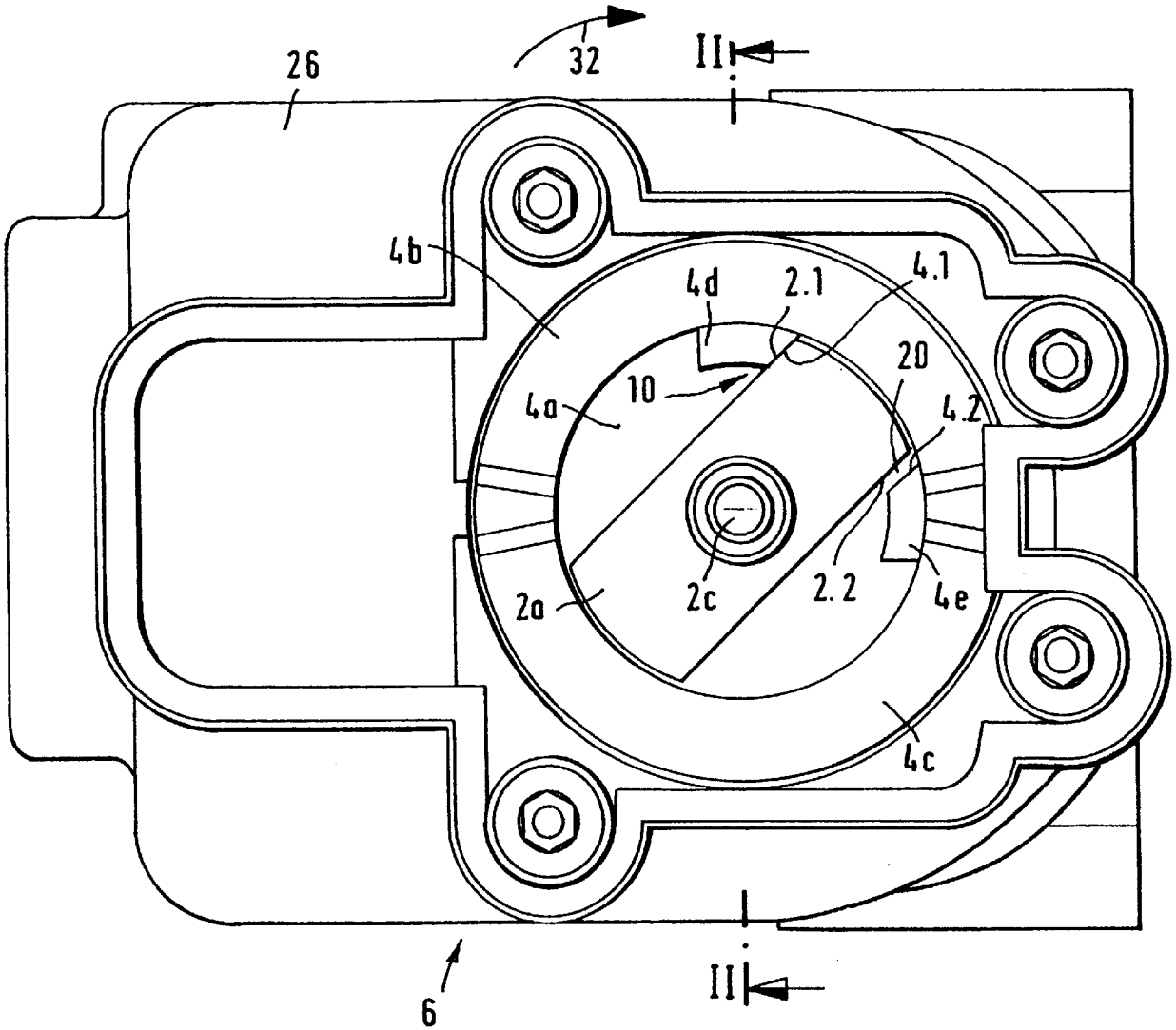
FIG. 3 is an end-on view of the first exemplary embodiment.

In FIGS. 2 and 3, the rotatable support of the control element 2 and drive element 4 is clearly seen.

In all the drawing figures, identical elements or those functioning identically are provided with the same reference numerals. Unless otherwise mentioned or shown in the drawing, what is said about and shown in one of the drawing figures applies to one of the other exemplary embodiments as well. Unless the explanations say otherwise, the details of the various exemplary embodiments can be combined with one another.

FIG. 2 shows a longitudinal section through the control device in the plane of the axis of rotation of the throttle valve shaft 2*c*. The sectional plane and direction of view of FIG. 2 is marked II—II in FIG. 3. FIG. 3 shows an end-on view of the control device; the viewing direction of FIG. 3 is marked III in FIG. 2. The restoring spring 12 is not shown in FIGS. 2 and 3 for the sake of greater clarity.

As FIG. 2 shows, the drive element 4, with the rotor 4*a* and the magnets 4*b*, 4*c* of the actuating drive 6, is rotatably supported, in a way that saves space and engineering effort and expense, directly on the throttle valve shaft 2*c* of the control element 2.

The restoring spring 12 acts counter to the arrow 32 on the control element 2, with the tendency to cause the control element stop 2.1 of the control element 2 to rest on the drive stop 4.1 without lifting up from it. The restoring spring 12 is reinforced by the detent device 10, which likewise firmly keeps the control element stop 2.1 in contact with the drive stop 4.1. As a result of these two provisions that mutually reinforce one another, it is a short and normal operation that the control element 2 follows the motion of the drive element 4 without play.

The permanent magnets 4*b*, 4*c* of the actuating drive 6 are secured to the rotor 4*a*. The rotor 4*a* comprises magnetizable soft iron. It is thereby attained that the magnetic force of the magnets 4*b*, 4*c* extends through the rotor 4*a* into the slaving pin 4*d*, so that this magnetic force pulls the control element stop 2.1 of the driver 2*a* against the slaving pin 4*d*. The action of the detent device 10 is engendered thereby.

Referring again to FIG. 1, the emergency spring 14 acts with one end on the rotor 4*a* of the drive element 4 in the direction of the arrow 32, and with its other end the emergency spring 14 is braced on the slaving element 22. The emergency spring 14 presses the slaving element 22 against the slaving element stop 4*f* provided on the drive element 4. Via the control element 2, the restoring spring 12 urges the drive element 4 counter to the arrow 32, until the slaving element 22 comes to rest on the emergency operation stop 24 provided on the housing 26. Since the force of the emergency spring 14, or the corresponding torque of the emergency spring 14, is greater than the force or torque of the restoring spring 12, the restoring spring 12 can adjust the drive element 4 counter to the direction of the arrow 32 only far enough that the slaving element 22 comes to rest on the emergency operation stop 24.

If the actuating drive 6 is not triggered, the control element 2 and the drive element 4 are in the position shown in the drawing. In this position, the throttle valve 2*b* is in a position in which the intake conduit of the driving engine is opened so far that emergency operation of the driving engine is possible.

If the power of the driving engine is to be increased, then the coil 30 is supplied with current, such that the actuating drive 6 adjusts the drive element 4 in the direction of the arrow 32. In the process, the drive stop 4.1, via the control element stop 2.1, presses the control element 2 in the full-load direction indicated by the arrow 32, counter to the force of the restoring spring 12. The actuating drive 6 can adjust the drive element 4 and the control element 2 far enough in the direction of the arrow 32 that the stop 2*g* of the control element 2 comes to contact the maximum stop 16.

If the power of the driving engine is to be reduced, then the coil 30 is supplied with current such that the actuating drive 6 actuates the rotor 4*a* in the closing direction, counter to the arrow 32, or in other words in the idling direction of the driving engine. If in the course of this motion the slaving element 22 has come to contact the emergency operation stop 24, then upon further motion of the drive element 4, the slaving element stop 4*f* lifts away from the slaving element 22, and the emergency spring 14 is increasingly tensed. The restoring spring 12 in this motion assures that the control element 2 will follow the motion of the drive element 4 without play. The actuating drive 6 and the restoring spring 12 can actuate the control element 2 counter to the arrow 32 only far enough that the stop 2*h* of the control element 2 comes to rest on the minimum stop 18.

Upon actuation of the control element 2 counter to the arrow 32, the restoring spring 12 increasingly relaxes. To assure a play-free connection between the control element 2 and the drive element 4 even with the restoring spring 12 relatively relaxed, when flow forces engage the throttle valve 2*b*, the restoring spring 12 is effectively reinforced by the detent device 10.

When the driving engine is shut off and the actuating drive 4 is not triggered, the control element 2 with the throttle valve 2*b* is in the position shown in the drawing. If for instance when the driving engine is started a motion resistance that firmly holds the control element 2 or the throttle valve 2*b*, for instance as a result of solid freezing of the throttle valve 2*b*, exceeds an amount such that the normal torque of the actuating drive 6 is no longer sufficient to put the control element 2 into motion, then the actuating drive 6 adjusts the drive element 4 counter to the arrow 32, so that the drive stop 4.1 lifts away from the control element stop 2.1. The actuating drive 6 actuates the drive element 4 in a lifting motion direction, and the drive element 4 lifts from the control element 2. The drive element 4 can be actuated by the length of the free-wheel 20, or the pivoting angle of the free-wheel 20. Once the drive stop 4.1 has lifted from the control element stop 2.1, the actuating drive 6 is reversed, causing the drive element 4 to be actuated in the direction of the arrow 32, specifically in such a way that the drive element 4 strikes the control element stop 2.1 with the greatest possible kinetic energy. As a result of the sudden stoppage of the drive element 4, a high acceleration force and thus a strong loosening impact force ensue. The force or torque engaging the control element 2 is substantially greater than the force or torque that typically can be generated by the magnetic forces of the actuating drive 6 alone. In many cases, a single impact suffices to make the control element 2 capable of motion again, so that after that normal adjustment of the control element 2 is possible.

The impact loosening of the control element 2 is additionally improved by the provision that with the control element 2 at a standstill, upon actuation of the drive element 4 counter to the arrow 32, the second control element stop 4.2 is also made to strike the second control element stop 2.2 of the control element 2 with the greatest possible kinetic energy. This impact of the drive element 4 against the control element 2 can be repeated in both directions until such time as the desired mobility of the control element 2 is achieved. The drive element 4 is moved back and forth by the length or angle of the free-wheel 20, and in alternation the drive stop 4.1 strikes the control element stop 2.2, and the second drive stop 4.2 strikes the second control element stop 2.2.

Because the magnetic force, exerted between the control element stop 2.1 and the drive stop 4.1, of the detent device 10 increases sharply shortly before the drive stop 4.1 comes into contact with the control element stop 2.2, the jarring loose of the control element 2 is effectively reinforced by the detent device 10. The emergency spring 14 also reinforces the striking of the drive stop 4.1 against the control element stop 2.2. As a result, the emergency spring 14 likewise effectively reinforces the impact loosening of the control element 2.

The mass of the drive element 4 together with the magnets 4*b,* 4*c* and the emergency spring 14 forms an oscillating body with a natural frequency. The impact loosening of the control element 2 becomes especially effective if the magnetic force of the actuating drive 6 is reversed in polarity with the frequency that corresponds to the natural frequency of the drive element 4, and as a result the drive element 4 swings back and forth from stop to stop at its natural frequency by the amount of the free-wheel 20.

Figure 4:
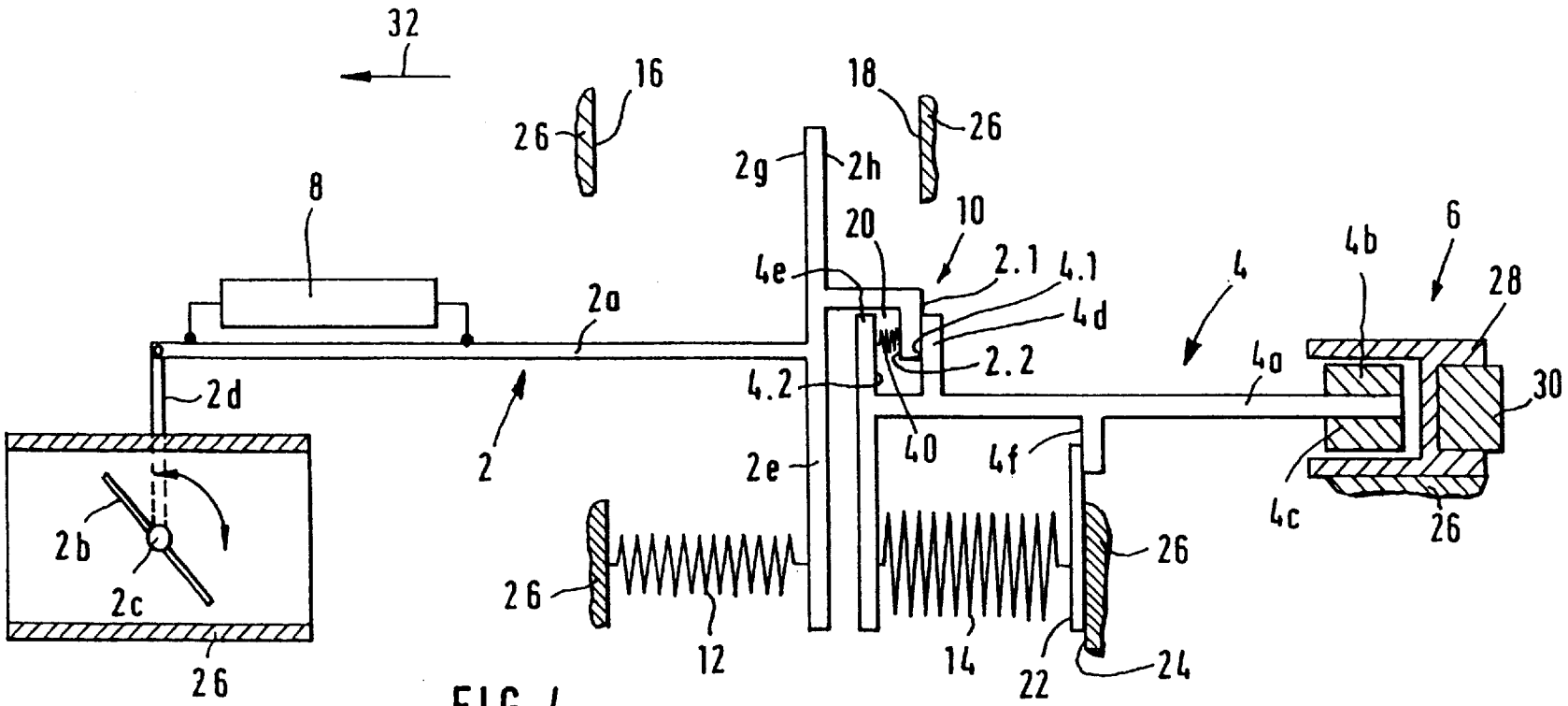
FIG. 4 is a linearized view of a second exemplary embodiment.

FIG. 4 in symbolic and linearized form shows a further example of a selected possibility for realizing the control device of the invention.

In the exemplary embodiment shown in FIG. 4, a coupling spring 40 that on one end engages the control element 2 and on the other engages the drive element 4 is provided. Functionally, the coupling spring 40 belongs to the detent device 10. The coupling spring 40 assures that in the normal operating state, the control element stop 2.1 of the control element 2 rests securely on the drive stop 4.1 of the drive element 4. As a result, if appropriate, there may be no need to embody the drive element 4 in such a way that the magnetic force of the magnets 4*b,* 4*c* attracts the control element stop 2.1 to the drive stop 4.1. Because the free-wheel 20 can be made relatively short, the coupling spring 40 can be relatively strong and nevertheless relatively small in size.

The detent moment exerted between the control element 2 and the drive element 4 by the magnetic force between the control element stop 2.1 and the drive stop 4.1, and/or selectively the detent moment of the detent device 10 generated by the coupling spring 40, is independent of the joint position of the control element 2 and the drive element 4. The detent moment of the detent device 10 forms a closed force system or a closed moment system, so that it has no effect on the requisite torque of the actuating drive 6.

The effect of the detent device 10 is that if interfering moments occur, which can act on the throttle valve 2*b,* for instance as a result of flow changes, the control element 2 is not unintentionally rotated in the opening direction. The detent device 10 is also fully effective whenever the control element 2 is in contact with the minimum stop 18, or in other words when the restoring spring 12 is extensively relaxed.

If the throttle valve 2*b* seizes, for instance because of damage or because a dirt particle is caught between the throttle valve 2*b* and the housing 26, and if as a result the restoring moment of the restoring spring 12 and the detent moment of the detent device 10 are not sufficient to adjust the control element 2 and the throttle valve 2*b* in the closing direction counter to the arrow 32, then at a drive moment counter to the arrow 32 in the closing direction, the drive stop 4.1 of the drive element 4 separates from the control element stop 2.1 of the control element 2, and after the free-wheel 20 is overcome, the second drive stop 4.2 strikes the second control element stop 2.2, so that now the drive moment of the actuating drive, acting as an additional closing moment and reinforcing the restoring spring 12, is now available counter to the arrow 32 at the control element 2 and at the throttle valve 2*b*. This effect is reinforced by the dynamic effect upon impact of the second drive stop 4.2 against the second control element stop 2.2.

The foregoing relates to preferred exemplary embodiments of the invention, it being understood that other variants and embodiments thereof are possible within the spirit and scope of the invention, the latter being defined by the appended claims.

We claim:

1. A control device for controlling a power of a driving engine, in particular a driving engine of a vehicle, having a control element (2, 2*a,* 2*b*) that determines the power of the driving engine and having an actuating drive (6) for adjusting the control element (2, 2*a,* 2*b*), the improvement comprising the control element (2, 2*a,* 2*b*) has a control element stop (2.1), and the actuating drive (6) has a drive element (4, 4*a*) provided with a drive stop (4.1), and the drive element, (4, 4*a*), via an engagement of the drive stop (4.1) with the control element stop (2.1), is adapted to adjust the control element (2, 2*a,* 2*b*), wherein if the control element (2, 2*a,* 2*b*) incurs a motion resistance exceeding a certain amount, the actuating drive (6) adjusts the drive element (4, 4*a*) in a lifting motion direction causing the drive stop (4.1) to lift away from the control element stop (2.1), whereupon an ensuing adjustment of the drive element (4) opposite from the lifting motion direction moves the drive stop (4.1) to strike the control element stop (2.1).

2. The control device according to claim 1, in which the drive element (4, 4*a*) has a second drive stop (4.2) and the control element (2, 2*a,* 2*b*) has a second control element stop (2.2), and upon adjustment of the drive element (4, 4*a*) in the lifting motion direction, the second drive stop (4.2) can come to rest on the second control element stop (2.2).

3. The control device according to claim 2, in which a detent device (10, 40) that keeps the control element stop (2.1) on the drive stop (4.1) is provided.

4. The control device according to claim 3, in which the detent device (10) comprises a magnetic force of a magnet (4*b,* 4*c*), which force acts between the control element (2, 2*a,* 2*b*) and the drive element (4, 4*a*), to actuate the control element stop (2.1) toward the drive stop (4.1).

5. The control device according to claim 4, in which the actuating drive (6) includes said magnet (4*b,* 4*c*).

6. The control device according to claim 3, in which the detent device (10) comprises a spring force of a coupling spring (40), which force acts between the control element (2, 2*a,* 2*b*) and the drive element (4, 4*a*), to actuate the control element stop (2.1) toward the drive stop (4.1).

7. The control device according to claim 2, in which a restoring spring (12) is provided to urge the control element stop (2.1) of the control element (2, 2*a,* 2*b*) toward the drive stop (4.1) of the drive element (4, 4*a*).

8. The control device according to claim 1, in which a detent device (10, 40) that keeps the control element stop (2.1) on the drive stop (4.1) is provided.

9. The control device according to claim 8, in which the detent device (10) comprises a magnetic force of a magnet (4*b,* 4*c*), which force acts between the control element (2, 2*a,* 2*b*) and the drive element (4, 4*a*), to actuate the control element stop (2.1) toward the drive stop (4.1).

10. The control device according to claim 9, in which the actuating drive (6) includes said magent (4*b,* 4*c*).

11. The control device according to claim 10, in which a restoring spring (12) is provided to urge the control element stop (2.1) of the control element (2, 2*a,* 2*b*) toward the drive stop (4.1) of the drive element (4, 4*a*).

12. The control device according to claim 9, in which a restoring spring (12) is provided to urge the control element stop (2.1) of the control element (2, 2*a,* 2*b*) toward the drive stop (4.1) of the drive element (4, 4*a*).

13. The control device according to claim 9, in which an emergency spring (14) is provided to keep the drive element (4, 4*a*) in an emergency position.

14. The control device according to claim 8, in which the detent device (10) comprises a spring force of a coupling spring (40), which force acts between the control element (2, 2*a*, 2*b*) and the drive element (4, 4*a*), to actuate the control element stop (2.1) toward the drive stop (4.1).

15. The control device according to claim 14, in which a restoring spring (12) is provided to urge the control element stop (2.1) of the control element (2, 2*a*, 2*b*) toward the drive stop (4.1) of the drive element (4, 4*a*).

16. The control device according to claim 14, in which an emergency spring (14) is provided to keep the drive element (4, 4*a*) in an emergency position.

17. The control device according to claim 8 in which a restoring spring (12) is provided to urge the control element stop (2.1) of the control element (2, 2*a*, 2*b*) toward the drive stop (4.1) of the drive element (4, 4*a*).

18. The control device according to claim 8, in which an emergency spring (14) is provided to keep the drive element (4, 4*a*) in an emergency position.

19. The control device according to claim 1, in which a restoring spring (12) is provided to urge the control element stop (2.1) of the control element (2, 2*a*, 2*b*) toward the drive stop (4.1) of the drive element (4, 4*a*).

20. The control device according to claim 1, in which an emergency spring (14) is provided to keep the drive element (4, 4*a*) in an emergency position.

21. The control device according to claim 20, in which the control element (2, 2*a*, 2*b*) is adjustable by the actuating drive (6) in a direction of greater power of the driving engine and in a direction of lesser power of the driving engine beginning at the emergency position.

* * * * *